US010138909B2

(12) United States Patent
Megens et al.

(10) Patent No.: US 10,138,909 B2
(45) Date of Patent: Nov. 27, 2018

(54) MULTI-CYLINDER ASSEMBLY

(71) Applicant: Eaton Corporation, Cleveland, OH (US)

(72) Inventors: Petrus Wilhelmus Maria Megens, Den Dungen (NL); Petrus Josephus Franciscus Claessens, Someren-Eind (NL); Chang-Chun Tsai, Jackson, MI (US)

(73) Assignee: EATON INTELLIGENT POWER, LTD, Dublin (IE)

( * ) Notice: Subject to any disclaimer, the term of this patent is extended or adjusted under 35 U.S.C. 154(b) by 369 days.

(21) Appl. No.: 14/889,615

(22) PCT Filed: May 7, 2014

(86) PCT No.: PCT/US2014/037099
§ 371 (c)(1),
(2) Date: Nov. 6, 2015

(87) PCT Pub. No.: WO2014/182783
PCT Pub. Date: Nov. 13, 2014

(65) Prior Publication Data

US 2016/0084273 A1 Mar. 24, 2016

Related U.S. Application Data

(60) Provisional application No. 61/821,480, filed on May 9, 2013.

(51) Int. Cl.
*F15B 11/036* (2006.01)

(52) U.S. Cl.
CPC ..... *F15B 11/0365* (2013.01)

(58) Field of Classification Search
CPC .. F15B 15/1404; F15B 11/0365; F15B 11/00; F15B 15/149; F16F 9/26; B21B 31/263; F02B 75/287
USPC ..... 92/169.1, 48
See application file for complete search history.

(56) References Cited

U.S. PATENT DOCUMENTS 1,031,528 A * 7/1912 Cole ..... F15B 11/0365 254/93 R
3,485,141 A * 12/1969 Douglas ..... F15B 11/0365 91/469
4,005,598 A * 2/1977 Ehmann ..... B21J 15/105 29/243.523
4,878,372 A * 11/1989 Port ..... B21J 15/022 29/243.525
5,375,994 A * 12/1994 Friderich ..... B29C 45/281 264/328.9

(Continued)

*Primary Examiner* — Nathaniel Wiehe
*Assistant Examiner* — Richard Drake
(74) *Attorney, Agent, or Firm* — Jarett D Millar

(57) ABSTRACT

A multi-cylinder assembly includes a cylinder assembly defining a bore and a piston-rod assembly slidably disposed in the bore of the cylinder assembly. The piston-rod assembly includes a piston rod, a piston-rod sleeve and a retainer. The piston rod includes a piston head, a first rod extending outwardly from the piston head and a rod extension extending outwardly from the first rod. The piston-rod sleeve is disposed about the rod extension of the piston rod. The piston-rod sleeve includes a head portion and a rod portion. The retainer is engaged to the rod extension. The retainer prohibits axial movement of the piston-rod sleeve.

21 Claims, 3 Drawing Sheets

(56) References Cited

U.S. PATENT DOCUMENTS

| | | | | |
|---|---|---|---|---|
| 5,615,595 | A * | 4/1997 | Davis | F15B 11/0365 91/440 |
| 6,604,451 | B1 * | 8/2003 | Yasuda | F15B 11/0365 248/550 |
| 6,907,648 | B2 * | 6/2005 | Eldessouky | B21J 15/105 29/243.523 |
| 7,287,941 | B1 * | 10/2007 | Erickson | B23B 31/263 408/239 R |
| 8,393,686 | B2 * | 3/2013 | Dunigan | B60P 1/162 298/22 R |

* cited by examiner

MULTI-CYLINDER ASSEMBLY

CROSS REFERENCE TO RELATED APPLICATION

This application is being filed on 7 May 2014, as a PCT International Patent application and claims priority to U.S. Patent Application Ser. No. 61/821,480 filed on 9 May 2013, the disclosure of which is incorporated herein by reference in its entirety.

BACKGROUND

Tandem cylinders are used in many applications. Typically, a tandem cylinder includes a pair of hydraulic chambers in series having respective pistons connected to a common output rod for common movement therewith. In service, two chambers may be used in tandem, or independently, to extend or retract the rod. The methods used to connect these pistons and common rod make assembly of these tandem cylinders difficult.

SUMMARY

An aspect of the present disclosure relates to a multi-cylinder assembly. The multi-cylinder assembly includes a cylinder assembly defining a bore and a piston-rod assembly slidably disposed in the bore of the cylinder assembly. The piston-rod assembly includes a piston rod, a piston-rod sleeve and a retainer. The piston rod includes a piston head, a first rod extending outwardly from the piston head and a rod extension extending outwardly from the first rod. The piston-rod sleeve is disposed about the rod extension of the piston rod. The piston-rod sleeve includes a head portion and a rod portion. The retainer is engaged to the rod extension. The retainer prohibits axial movement of the piston-rod sleeve.

Another aspect of the present disclosure relates to a multi-cylinder assembly. The multi-cylinder assembly includes a cylinder assembly having a first cylinder body defining a first bore and a second cylinder body defining a second bore. The multi-cylinder assembly further includes a piston-rod assembly slidable disposed in the cylinder assembly. The piston-rod assembly includes a piston rod, a piston-rod sleeve and a retainer. The piston rod has a piston head, a first rod extending outwardly from the piston head and a rod extension extending outwardly from the first rod. The piston head is disposed in the first bore of the first cylinder body of the cylinder assembly. The piston-rod sleeve is disposed about the rod extension of the piston rod. The piston-rod sleeve includes a head portion and a rod portion. The head portion is disposed in the second bore of the second cylinder body of the cylinder assembly. The retainer is engaged to the rod extension. The retainer prohibits axial movement of the piston-rod sleeve.

Another aspect of the present disclosure relates to a piston-rod assembly for a multi-cylinder assembly. The piston rod assembly includes a piston rod, a piston-rod sleeve and a retainer. The piston rod includes a piston head, a first rod extending outwardly from the piston head and a rod extension extending outwardly from the first rod. An outer diameter of the rod extension is less than an outer diameter of the first rod. The piston-rod sleeve is disposed about the rod extension of the piston rod. The piston-rod sleeve includes a head portion and a rod portion. A retainer is engaged to the rod extension. The retainer abuts the piston-rod sleeve.

Another aspect of the present disclosure relates to a method of assembling a piston-rod assembly for a multi-cylinder assembly. The method includes providing a piston rod having a piston head, a first rod extending outwardly from the piston head and a rod extension extending outwardly from the first rod. A piston-rod sleeve defining a central bore is provided. The piston-rod sleeve includes a head portion and a rod portion. The piston-rod sleeve is slid over the rod extension so that the rod extension passes through the central bore of the piston-rod sleeve. A retainer is engaged to the rod extension so that the retainer prohibits axial movement of the piston-rod sleeve along the rod extension.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
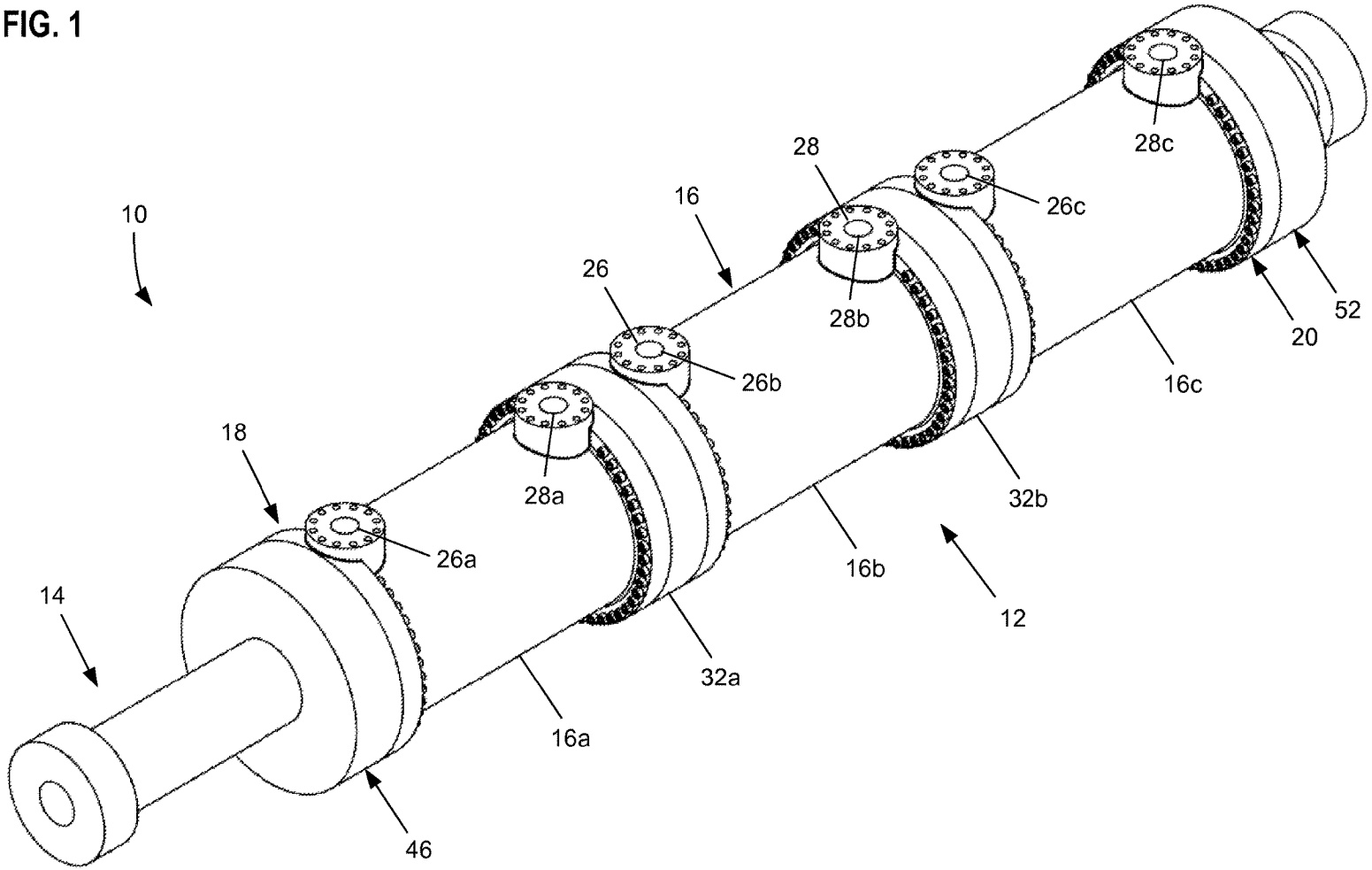
FIG. 1 is an isometric view of a multi-cylinder assembly having exemplary features of aspects in accordance with the principles of the present disclosure.

Referring now to FIG. 1, a multi-cylinder assembly 10 is shown. The multi-cylinder assembly 10 includes a cylinder assembly 12 and a piston-rod assembly 14.

Figure 2:
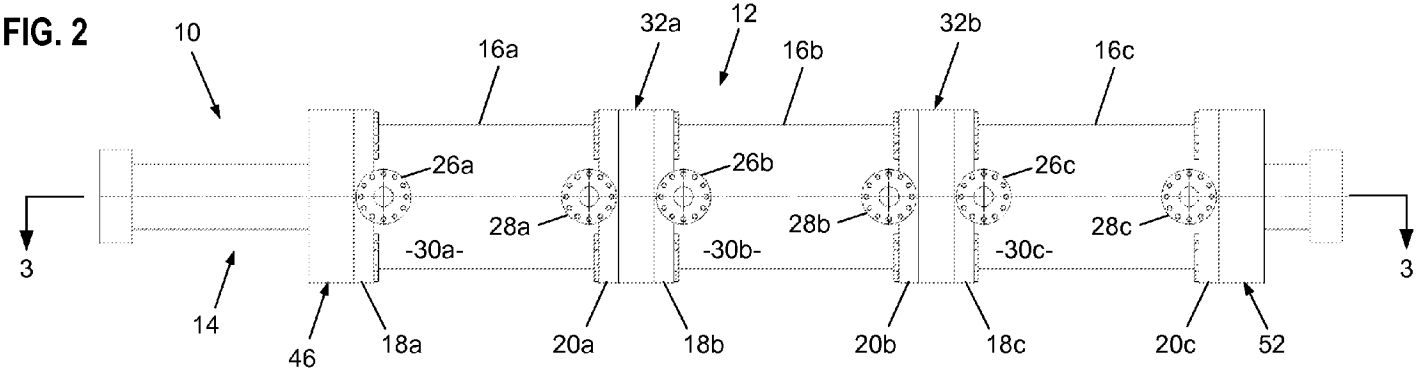
FIG. 2 is a top view of the multi-cylinder assembly of FIG. 1.
Figure 3:
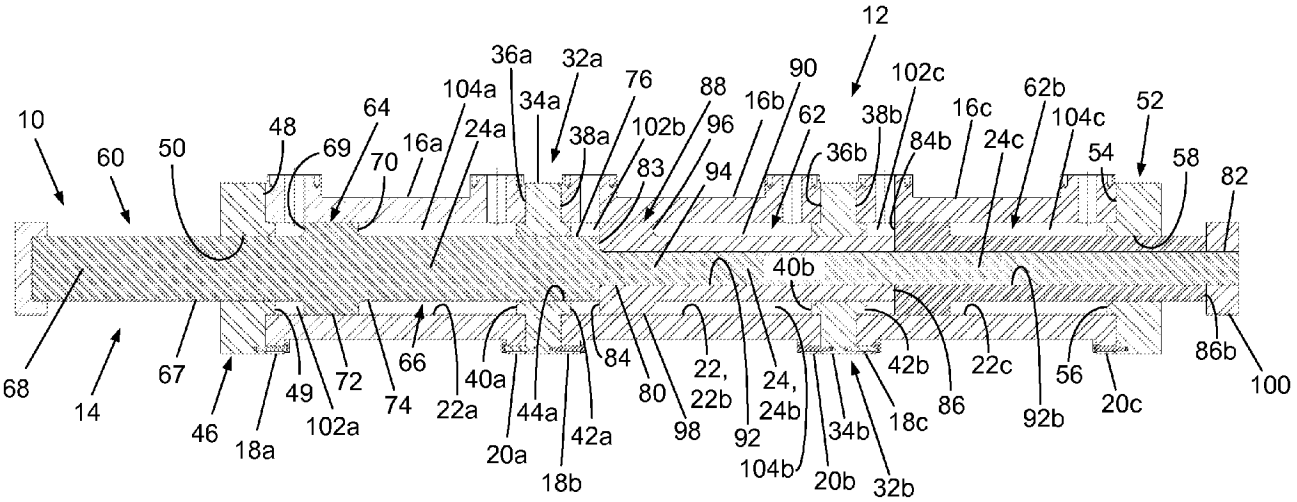
FIG. 3 is a cross-sectional view of the multi-cylinder assembly taken on line 3-3 of FIG. 2.

Referring now to FIGS. 1-3, the cylinder assembly 12 includes a body 16. The body 16 includes a first axial end 18 and an oppositely disposed second axial end 20.

The cylinder assembly 12 defines a bore 22 that extends through the first and second axial ends 18, 20. The bore 22 defines a central longitudinal axis 24.

In the depicted embodiment, the body 16 of the cylinder assembly 12 includes a plurality of cylinder bodies 16. In one embodiment, the cylinder assembly 12 includes at least two cylinder bodies 16. In the depicted embodiment, the cylinder assembly 12 includes a first cylinder body 16*a*, a second cylinder body 16*b* and a third cylinder body 16*c*.

The first cylinder body 16*a* includes a first axial end 18*a* and an oppositely disposed second axial end 20*a*. The first cylinder body 16*a* defines a first bore 22*a* that extends through the first and second axial ends 18*a*, 20*a* of the first cylinder body 16*a*. The first bore 22*a* defines a first central longitudinal axis 24*a*.

The first cylinder body 16*a* further defines a first port 26*a* and a second port 28*a*. The first and second ports 26*a*, 28*a* are in fluid communication with the first bore 22*a*. The first port 26*a* is disposed adjacent the first axial end 18*a* while the second port 28*a* is disposed adjacent the second axial end 20*a*. The first and second ports 26*a*, 28*a* extend through an exterior surface 30*a* of the first cylinder body 16*a* and into the first bore 22*a*. In the depicted embodiment, the first and second ports 26*a*, 28*a* extend radially outwardly through the first cylinder body 16*a*. In the depicted embodiment, the first port 26*a* is in alignment with the second port 28*a* along the first central longitudinal axis 24*a*.

The second cylinder body 16*b* includes a first axial end 18*b* and an oppositely disposed second axial end 20*b*. The second cylinder body 16*b* defines a second bore 22*b* that extends through the first and second axial ends 18*b*, 20*b* of the second cylinder body 16*b*. The second bore 22*b* defines a second central longitudinal axis 24*b*.

The second cylinder body 16*b* further defines a first port 26*b* and a second port 28*b*. The first and second ports 26*b*, 28*b* are in fluid communication with the second bore 22*b*. The first port 26*b* is disposed adjacent the first axial end 18*b* while the second port 28*b* is disposed adjacent the second axial end 20*b*. The first and second ports 26*b*, 28*b* extend through an exterior surface 30*b* of the second cylinder body 16*b* and into the second bore 22*b*. In the depicted embodiment, the first and second ports 26*b*, 28*b* extend radially outwardly through the second cylinder body 16*b*. In the depicted embodiment, the first port 26*b* is in alignment with the second port 28*b* along the second central longitudinal axis 24*b*.

The third cylinder body 16*c* includes a first axial end 18*c* and an oppositely disposed second axial end 20*c*. The third cylinder body 16*c* defines a third bore 22*c* that extends through the first and second ends 18*c*, 20*c* of the third cylinder body 16*c*. The third bore 22*c* defines a third central longitudinal axis 24*c*.

The third cylinder body 16*c* further defines a first port 26*c* and a second port 28*c*. The first and second ports 26*c*, 28*c* are in fluid communication with the third bore 22*c*. The first port 26*c* is disposed adjacent the first end 18*c* while the second port 28*c* is disposed adjacent the second end 20*c*. The first and second ports 26*c*, 28*c* extend through an exterior surface 30*c* of the third cylinder body 16*c* and into the third bore 22*c*. In the depicted embodiment, the first and second ports 26*c*, 28*c* of the third cylinder body 16*c* extend radially outwardly through the third cylinder body 16*c*. In the depicted embodiment, the first port 26*c* is in alignment with the second port 28*c* along the third central longitudinal axis 24*c*.

The cylinder assembly 12 further includes a coupler 32. The coupler 32 is adapted to connect adjacent cylinder bodies 16. The coupler 32 cooperates with the piston-rod assembly 14 to prevent fluid communication between the adjacent bores 22 of the cylinder assembly 12. In the depicted embodiment, the cylinder assembly 12 includes a first coupler 32*a* that is adapted to connect the first cylinder body 16*a* to the second cylinder body 16*b* and a second coupler 32*b* that is adapted to connect the second cylinder body 16*b* with the third cylinder body 16*c*. The first coupler 32*a* cooperates with the piston-rod assembly 14 to prevent fluid communication between the first bore 22*a* of the first cylinder body 16*a* and the second bore 22*b* of the second cylinder body 16*b*. The second coupler 32*b* cooperates with the piston-rod assembly 14 to prevent fluid communication between the second bore 22*b* of the second cylinder body 16*b* and the third bore 22*c* of the third cylinder body 16*c*. In one embodiment, the first and second couplers 32*a*, 32*b* include rod seals (not shown) that seal against the piston-rod assembly to prevent fluid communication between adjacent bores 22*a-c*.

The first coupler 32*a* includes a body 34 having a first surface 36*a* and an oppositely disposed second surface 38*a*. When the first coupler 32*a* is connectedly engaged to the first and second cylinder bodies 16*a*, 16*b*, the first surface 36*a* of the first coupler 32*a* is abutted against the second axial end 20*a* of the first cylinder body 16*a* and the second surface 38*a* of the first coupler 32*a* is abutted against the first axial end 18*b* of the second cylinder body 16*b*. A first pilot 40*a* extends outwardly from the first surface 36*a*. A second pilot 42*a* extends outwardly from the second surface 38*a*. The first and second pilots 40*a*, 42*a* are adapted to be received in the first and second bores 22*a*, 22*b*, respectively, of the first and second bodies 16*a*, 16*b* when the first coupler 32*a* is connectedly engaged to the first and second cylinder bodies 16*a*, 16*b*.

The first coupler 32*a* defines a thru-bore 44*a* that extends through the first and second pilots 40*a*, 42*a* of the first coupler 32*a*. In the depicted embodiment, an inner diameter of the thru-bore 44*a* is less than an inner diameter of the first bore 22*a* of the first cylinder body 16*a*. In the depicted embodiment, the inner diameter of the thru-bore 44*a* is less than an inner diameter of the second bore 22*b* of the second cylinder body 16*b*.

The second coupler 32*b* includes a body 34*b* having a first surface 36*b* and an oppositely disposed second surface 38*b*. When the second coupler 32*b* is connectedly engaged to the second and third cylinder bodies 16*b*, 16*c*, the first surface 36*b* of the second coupler 32*b* is abutted against the second axial end 20*b* of the second cylinder body 16*b* and the second surface 38*b* of the second coupler 32*b* is abutted against the first axial end 18*c* of the third cylinder body 16*c*. A first pilot 40*b* extends outwardly from the first surface 36*b* of the second coupler 32*b*. A second pilot 42*b* extends outwardly from the second surface 38*b* of the second coupler 32*b*. The first and second pilots 40*b*, 42*b* are adapted to be received in the second and third bores 22*b*, 22*c*, respectively, of the second and third bodies 16*b*, 16*c* when the second coupler 32*b* is connectedly engaged to the second and third cylinder bodies 16*b*, 16*c*.

The second coupler 32*b* defines a thru-bore 44*b* that extends through the first and second pilots 40*b*, 42*b* of the second coupler 32*b*. In the depicted embodiment, an inner diameter of the thru-bore 44*b* is less than an inner diameter of the second bore 22*b* of the second cylinder body 16*b*. In the depicted embodiment, the inner diameter of the thru-bore 44*b* is less than an inner diameter of the third bore 22*c* of the third cylinder body 16*c*.

The cylinder assembly 12 further includes a first end cap 46. The first end cap 46 is in connected engagement with the first axial end 18 of the cylinder assembly 12. In the depicted embodiment, the first end cap 46 is in connected engagement with the first axial end 18*a* of the first cylinder body 16*a*. The first end cap 46 includes a surface 48. When the first end cap 46 is connectedly engaged with the first cylinder body 16*a*, the surface 48 abuts the first axial end 18*a* of the first cylinder body 16*a*.

The first end cap 46 includes a pilot 49 that extends outwardly from the surface 48. The pilot 49 is adapted to be received in bore 22 of the cylinder assembly 12 when the first end cap 46 is engaged to the cylinder body 16. In the depicted embodiment, the pilot 49 is adapted to be received in the first bore 22*a* of the first cylinder body 16*a* when the first end cap 46 is connectedly engaged to the first cylinder body 16*a*.

The first end cap 46 defines an opening 50 that extends through the first end cap 46. The opening 50 is adapted to receive a portion of the piston-rod assembly 14. In the depicted embodiment, an internal diameter of the opening 50 is less than the inner diameter of the first bore 22*a*. When the first end cap 46 is engaged to the cylinder body 16, the opening 50 is generally aligned with the central longitudinal axis 24 of the bore 22. In the depicted embodiment, when the first end cap 46 is connectedly engaged to the first cylinder body 16*a*, the opening 50 is generally coaxially aligned with the first central longitudinal axis 24*a* of the first bore 22*a*.

The cylinder assembly 12 further includes a second end cap 52. The second end cap 52 is in connected engagement with the second axial end 20 of the cylinder assembly 12. In the depicted embodiment, the second end cap 52 is in connected engagement with the third cylinder body 16*c*. The second end cap 52 includes a surface 54. When the second end cap 52 is connectedly engaged with the third cylinder body 16*c*, the surface 54 abuts the second axial end 18*c* of the third cylinder body 16*c*.

The second end cap 52 includes a pilot 56 that extends outwardly from the surface 54. The pilot 56 is adapted to be received in the bore 22 of the cylinder assembly 12 when the second end cap 56 is engaged to the cylinder body 16. In the depicted embodiment, the pilot 56 is adapted to be received in the third bore 22*c* of the third cylinder body 16*c* when the second end cap 52 is connectedly engaged to the third cylinder body 16*c*.

The second end cap 52 defines an opening 58 that extends through the second end cap 52. The opening 58 is adapted to receive a portion of the piston-rod assembly 14. In the depicted embodiment, an internal diameter of the opening 58 is less than the inner diameter of the third bore 22*c*. When the second end cap 52 is engaged to the cylinder body 16, the opening 58 is generally aligned with the central longitudinal axis 24 of the bore 22. In the depicted embodiment, when the second end cap 52 is connectedly engaged to the third cylinder body 16*c*, the opening 58 is generally coaxially aligned with the third central longitudinal axis 24*c* of the third bore 22*c*.

Referring now to FIG. 3, the piston-rod assembly 14 will be described. The piston-rod assembly 14 is slidably disposed in the bore 22 of the cylinder assembly 12. The piston-rod assembly 14 includes a piston rod 60 and a piston-rod sleeve 62.

The piston rod 60 includes a piston head 64, a first rod 66 that extends outwardly from the piston head 64 and a second rod 67 that extends outwardly from the piston head 64 in a direction opposite the first rod 66. In the depicted embodiment, the second rod 67 extends outwardly from the cylinder assembly 12 and is adapted to engage a component, work implement, load, etc.

The piston rod 60 defines a longitudinal axis 68. When the piston-rod assembly 14 is disposed in the bore 22 of the cylinder assembly 12, the longitudinal axis 68 of the piston-rod assembly 14 is generally aligned with the central longitudinal axis 24 of the bore 22 of the cylinder assembly 12.

The piston head 64 includes a first end 69 and an oppositely disposed second end 70. In the depicted embodiment, the first and second ends 69, 70 are generally perpendicular to the longitudinal axis 68 of the piston-rod assembly 14. The piston head 64 further includes an outer surface 72 that extends between the first and second ends 69, 70. The outer surface 72 is generally cylindrical in shape. An outer diameter of the outer surface 72 of the piston head 64 is slightly less than the inner diameter of the bore 22 of the cylinder assembly 12 so that the piston-rod assembly 14 can slide in the bore 22 of the cylinder assembly 12. The outer surface 72 defines a circumferential groove (not shown) that is adapted to retain a piston seal (not shown). The piston seal is adapted to provide a seal between the piston head 64 and the bore 22 of the cylinder assembly 12.

The first rod 66 extends outwardly from the piston head 64 in a direction that is generally parallel to the longitudinal axis 68 of the piston-rod assembly 14. The first rod 66 is generally cylindrical in shape. The first rod 66 has an outer diameter that is less than the outer diameter of the piston head 64.

In the depicted embodiment, the first rod 66 includes a first end portion 74 and an oppositely disposed second end portion 76. The first end portion 74 extends outwardly from the second end 70 of the piston head 64.

A rod extension 78 extends outwardly from the first rod 66 in a direction that is generally parallel to the longitudinal axis 68 of the piston-rod assembly 14. The rod extension 78 is generally cylindrical in shape. The rod extension 78 has an outer diameter that is less than the outer diameter of the first rod 66.

In the depicted embodiment, the rod extension 78 includes a first axial end portion 80 and an oppositely disposed second axial end portion 82. The first axial end portion 80 is disposed adjacent to the second end portion 76 of the first rod 66 so that the first axial end portion 80 extends outward from the second end portion 76 of the first rod 66. The rod extension 78 and the first rod 66 cooperatively define a shoulder 83 at the interface of the rod extension 78 and the first rod 66. In the depicted embodiment, the shoulder 83 is formed by the first axial end portion 80 of the rod extension 78 and the second end portion 74 of the first rod 66.

Referring still to FIG. 3, the piston-rod sleeve 62 will be described. The piston-rod sleeve 62 includes a first end surface 84 and an oppositely disposed second end surface 86. In the depicted embodiment, the piston-rod sleeve 62 includes a head portion 88 disposed adjacent to the first end surface 84 and a rod portion 90 disposed adjacent the second end surface 86. In the depicted embodiment, the head portion 88 and the rod portion 90 are integral. In another embodiment, the head portion 88 and the rod portion 90 are distinct parts.

The piston-rod sleeve 62 defines a central bore 92 that extends through the head portion 88 and the rod portion 90 of the piston-rod sleeve 62. The central bore 92 is adapted to slidably receive the rod extension 78 of the piston-rod assembly 14. The central bore 92 of the piston-rod sleeve 62 defines a central axis 94 that extends in a longitudinal direction through the head portion 88 and the rod portion 90 of the piston-rod sleeve 62.

The head portion 88 includes an annular surface 96 disposed opposite the first end surface 84 of the piston-rod sleeve 62. The annular surface 96 is generally perpendicular to the central axis 94. The head portion 88 further includes a circumferential surface 98 that extends between the first end surface 84 and the annular surface 96. In the depicted embodiment, an outer diameter of the circumferential surface 98 is about equal to the outer diameter of the outer surface 72 of the piston head 64 of the piston rod 60.

The rod portion 90 extends outwardly from the annular surface 96 of the head portion 88. The rod portion 90 extends from the annular surface 96 of the head portion 88 to the second end surface 86 of the piston-rod sleeve 62. In the depicted embodiment, an outer diameter of the rod portion 90 is about equal to the outer diameter of the first rod 66.

To assembly the piston-rod assembly 14, the central bore 92 of the piston-rod sleeve 62 is aligned with the rod extension 78 of the piston rod 60. The rod extension 78 is first passed through the central bore 92 at the head portion 88 of the piston-rod sleeve 62. The rod extension 78 is passed through the central bore 92 until the first end surface 84 of the piston-rod sleeve 62 abuts the shoulder 83 of the piston rod 60. In one embodiment, a seal is disposed between the piston rod 60 and the piston-rod sleeve 62 to prevent fluid from leaking between the rod extension 78 of the piston rod 60 and the piston-rod sleeve 62.

In the depicted embodiment, the rod extension 78 of the piston rod 60 is then passed through a central bore 92*b* of a second piston-rod sleeve 62*b* until a first end surface 84*b* of the second piston-rod sleeve 62*b* abuts the second end surface 86 of the piston-rod sleeve 62. In one embodiment, a seal is disposed between the piston rod 60 and the second piston-rod sleeve 62 to prevent fluid from leaking between the rod extension 78 of the piston rod 60 and the piston-rod sleeve 62*b*.

While the piston-rod sleeve 62 is slidably disposed about the rod extension 78 of the piston rod 60, a retainer 100 is used to retain the position of the piston-rod sleeve 62 relative to the piston rod 60. In the depicted embodiment, the retainer 100 is a nut that is threadedly engaged to the second axial end portion 82 of the rod extension 78 of the piston rod 60.

In the depicted embodiment, with the first end surface 84 of the piston-rod sleeve 62 abutting the shoulder 83 of the piston rod 60 and the first end surface 84*b* of the second piston-rod sleeve 62*b* abutting the second end surface 86 of the piston-rod sleeve 62, the retainer 100 is threadedly engaged to the second axial end portion 82 of the rod extension 78 of the piston rod 60 so that the retainer 100 abuts a second end surface 86*b* of the second piston-rod sleeve 62*b*. The retainer 100 prohibits axial movement of the piston-rod sleeve 62 and the second piston-rod sleeve 62*b* along the rod extension 78.

With the multi-cylinder assembly 10 assembled, the piston head 64 of the piston rod 60 is disposed in the first bore 22*a* of the first cylinder body 16*a*. The piston head 64 separates the first bore 22*a* into a first chamber 102*a* and a second chamber 104*a*. The first chamber 102*a* of the first bore 22*a* is in fluid communication with the first port 26*a* of the first cylinder body 16*a* while the second chamber 104*a* of the first bore 22*a* is in fluid communication with the second port 28*a* of the first cylinder body 16*a*.

The head portion 88 of the piston-rod sleeve 62 is disposed in the second bore 22*b* of the second cylinder body 16*b*. The head portion 88 separates the second bore 22*b* into a first chamber 102*b* and a second chamber 104*b*. The first chamber 102*b* of the second bore 22*b* is in fluid communication with the first port 26*b* of the second cylinder body 16*b* while the second chamber 104*b* of the second bore 22*b* is in fluid communication with the second port 28*b* of the second cylinder body 16*b*.

The head portion 88*b* of the second piston-rod sleeve 62*b* is disposed in the third bore 22*c* of the third cylinder body 16*c*. The head portion 88*b* separates the third bore 22*c* into a first chamber 102*c* and a second chamber 104*c*. The first chamber 102*c* of the third bore 22*c* is in fluid communication with the first port 26*c* of the third cylinder body 16*c* while the second chamber 104*c* of the third bore 22*c* is in fluid communication with the second port 28*c* of the second cylinder body 16*c*.

During operation, fluid is routed to the first or second ports 26, 28 of the cylinder bodies 16. The fluid enters the first or second ports 26, 28 and is routed to one of the first and second chambers 102, 104 of each of the cylinder bores 22. The first or second chambers 102*a-c*, 104*a-c* of the cylinder bores 22*a-c* act cumulatively to generate a force that acts through the piston-rod assembly 14 to accomplish a task (e.g., move a load, etc.).

Figure 4:
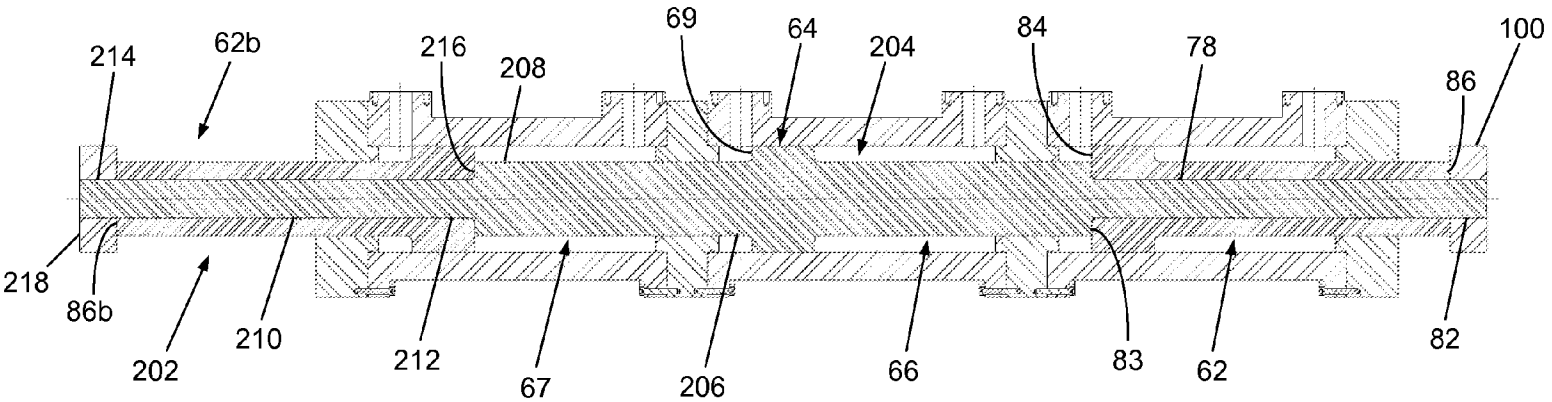
FIG. 4 is a cross-sectional view of an alternate embodiment of a multi-cylinder assembly having exemplary features of aspects in accordance with the principles of the present disclosure.

Referring now to FIG. 4, an alternate embodiment of a multi-cylinder assembly 200 is shown. In this alternate embodiment, features that were previously described will have the same reference numerals that were previously provided. New features will have reference numerals in excess of 200.

The multi-cylinder assembly 200 includes the cylinder assembly 12 and a piston-rod assembly 202. The cylinder assembly 12 has been described above. The piston-rod assembly 202 includes a piston rod 204, the piston-rod sleeve 62 and the second piston-rod sleeve 62*b*.

The piston rod 204 includes the piston head 64, the first rod 66 that extends outwardly from the piston head 64 and the second rod 67 that extends outwardly from the piston head 64 in a direction opposite the first rod 66. The first rod 66 includes the rod extension 78 that extends outwardly from the second end portion 76 of the first rod 66. The piston-rod sleeve 62 is slidably disposed about the rod extension 78. With the first end surface 84 of the piston-rod sleeve 62 abutting the shoulder 83 of the piston rod 204, the retainer 100 is threadedly engaged to the second axial end portion 82 of the rod extension 78 of the piston rod 204 so that the retainer 100 abuts the second end surface 86 of the piston-rod sleeve 62. The retainer 100 prohibits axial movement of the piston-rod sleeve 62 along the rod extension 78.

The second rod 67 includes a first end portion 206 and an oppositely disposed second end portion 208. The first end portion 206 extends outwardly from the first end 69 of the piston head 64. In the depicted embodiment, the second rod 67 and the piston head 64 are integral.

A second rod extension 210 extends outwardly from the second rod 67 in a direction that is generally parallel to the longitudinal axis 68 of the piston-rod assembly 202. In the depicted embodiment, the second rod extension 210 includes a first axial end portion 212 and an oppositely disposed second axial end portion 214. The first axial end portion 212 is disposed adjacent to the second end portion 208 of the second rod 67 so that the first axial end portion 212 extends outward from the second end portion 208 of the second rod 67. The second rod extension 210 and the second rod 67 cooperatively define a second shoulder 216 at the interface of the second rod extension 210 and the second rod 67.

The second piston-rod sleeve 62*b* is slidably disposed about the second rod extension 210. With the first end surface 84*b* of the second piston-rod sleeve 62*b* abutting the second shoulder 216 of the piston rod 204, a second retainer 218 is threadedly engaged to the second axial end portion 214 of the second rod extension 210 of the piston rod 204 so that the second retainer 218 abuts the second end surface 86*b* of the second piston-rod sleeve 62*b*. The second retainer 218 prohibits axial movement of the second piston-rod sleeve 62*b* along the second rod extension 210.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A multi-cylinder assembly comprising:

a cylinder assembly defining a bore;

a piston-rod assembly slidably disposed in the bore of the cylinder assembly, the piston-rod assembly including:

a piston rod having a piston head, a first rod extending outwardly from the piston head, a second rod extending outwardly from the piston head in a direction opposite the first rod, and a rod extension extending outwardly from the first rod;

a piston-rod sleeve disposed about the rod extension of the piston rod, the piston-rod sleeve including a head portion and a rod portion; and a retainer engaged to the rod extension, wherein the retainer prohibits axial movement of the piston-rod sleeve.

2. The multi-cylinder assembly of claim 1, wherein the piston-rod sleeve defines a central bore in which the rod extension is disposed.

3. The multi-cylinder assembly of claim 1, wherein an outer diameter of the rod extension is less than an outer diameter of the first rod.

4. The multi-cylinder assembly of claim 3, wherein the rod extension and the first rod cooperatively define a shoulder.

5. The multi-cylinder assembly of claim 4, wherein the piston-rod sleeve includes a first end surface and an oppositely disposed second end surface, the first end surface abutting the shoulder of the piston rod and the second end surface abutting the retainer.

6. The multi-cylinder assembly of claim 1, further comprising a second piston-rod sleeve disposed about the rod extension of the piston rod.

7. The multi-cylinder assembly of claim 6, wherein the piston-rod sleeve includes a first end surface and an oppositely disposed second end surface, the first end surface abutting a shoulder of the piston rod defined by the first rod and the rod extension.

8. The multi-cylinder assembly of claim 7, wherein the second piston-rod sleeve includes a first end surface and an oppositely disposed second end surface, the first end surface of the second piston-rod sleeve abutting the second end surface of the piston-rod sleeve, the second end surface of the second piston-rod sleeve abutting the retainer.

9. The multi-cylinder assembly of claim 1, wherein the head portion and the rod portion of the piston-rod sleeve are integral.

10. The multi-cylinder assembly of claim 1, wherein a second rod extension extends outwardly from the second rod.

11. The multi-cylinder assembly of claim 10, wherein a second piston-rod sleeve is disposed about the second rod extension, the second piston-rod sleeve including a head portion and a rod portion.

12. The multi-cylinder assembly of claim 11, further comprising a second retainer engaged to the second rod extension, wherein the second retainer prohibits axial movement of the second piston-rod sleeve.

13. A piston-rod assembly for a multi-cylinder assembly comprising:

a piston rod having a piston head, a first rod extending outwardly from the piston head, a second rod extending outwardly from the piston head in a direction opposite the first rod, and a rod extension extending outwardly from the first rod, wherein an outer diameter of the rod extension is less than an outer diameter of the first rod;

a piston-rod sleeve disposed about the rod extension of the piston rod, the piston-rod sleeve including a head portion and a rod portion; and a retainer engaged to the rod extension, wherein the retainer abuts the piston-rod sleeve.

14. The piston-rod assembly of claim 13, wherein a second rod extension extends outwardly from the second rod.

15. The piston-rod assembly of claim 14, wherein a second piston-rod sleeve is disposed about the second rod extension, the second piston-rod sleeve including a head portion and a rod portion.

16. The piston-rod assembly of claim 15, further comprising a second retainer engaged to the second rod extension, wherein the second retainer prohibits axial movement of the second piston-rod sleeve.

17. A method of assembling a piston-rod assembly for a multi-cylinder assembly, the method comprising the steps of:

providing a piston rod having a piston head, a first rod extending outwardly from the piston head, a second rod extending outwardly from the piston head in a direction opposite the first rod, and a rod extension extending outwardly from the first rod;

providing a piston-rod sleeve defining a central bore, the piston-rod sleeve including a head portion and a rod portion;

sliding the piston-rod sleeve over the rod extension so that the rod extension passes through the central bore of the piston-rod sleeve;

engaging a retainer to the rod extension so that the retainer prohibits axial movement of the piston-rod sleeve along the rod extension.

18. The method of claim 17, wherein the retainer is threaded onto the rod extension.

19. The method of claim 17, wherein the piston-rod sleeve abuts a shoulder defined by the first rod and the rod extension when the retainer is engaged to the rod extension.

20. The method of claim 17, wherein the piston rod includes a second rod extension extending outwardly from the second rod.

21. The method of claim 20, further comprising:

providing a second piston-rod sleeve defining a central bore, the second piston-rod sleeve including a head portion and a rod portion;

sliding the second piston-rod sleeve over the second rod extension so that the second rod extension passes through the central bore of the second piston-rod sleeve; and engaging a second retainer to the second rod extension so that the second retainer prohibits axial movement of the second piston-rod sleeve.

* * * * *